US010774478B2

(12) United States Patent
Baker

(10) Patent No.: US 10,774,478 B2
(45) Date of Patent: Sep. 15, 2020

(54) RAILWAY TRACK DISPLACEMENT MEASUREMENT SYSTEM AND METHOD FOR PROACTIVE MAINTENANCE

(71) Applicant: SIEMENS RAIL AUTOMATION PTY. LTD., Melbourne, Victoria (AU)

(72) Inventor: Stephen Baker, Melbourne (AU)

(73) Assignee: Siemens Mobility Pty Ltd., Bayswater (AU)

( * ) Notice: Subject to any disclaimer, the term of this patent is extended or adjusted under 35 U.S.C. 154(b) by 232 days.

(21) Appl. No.: 16/063,158

(22) PCT Filed: Dec. 17, 2015

(86) PCT No.: PCT/US2015/066226

§ 371 (c)(1),
(2) Date: Jun. 15, 2018

(87) PCT Pub. No.: WO2017/105451

PCT Pub. Date: Jun. 22, 2017

(65) Prior Publication Data

US 2018/0371699 A1 Dec. 27, 2018

(51) Int. Cl.
*E01B 35/12* (2006.01)
*B61L 23/04* (2006.01)

(52) U.S. Cl.
CPC ..... *E01B 35/12* (2013.01); *B61L 23/047* (2013.01)

(58) Field of Classification Search
CPC ..... E01B 35/00; E01B 35/12; B61L 23/00; B61L 23/041; B61L 23/047
See application file for complete search history.

(56) References Cited

U.S. PATENT DOCUMENTS 5,791,063 A * 8/1998 Kesler ..... E01B 35/00 33/1 Q
2010/0252692 A1* 10/2010 Tsai ..... B61L 23/042 246/121
2017/0268180 A1* 9/2017 Lichtberger ..... B61K 9/00
2017/0328013 A1* 11/2017 Lichtberger ..... E01B 27/17
2018/0371699 A1* 12/2018 Baker ..... E01B 35/12
(Continued)

FOREIGN PATENT DOCUMENTS

DE 3844663 A1 6/1990
DE 102006042802 A1 9/2007
DE 102010045465 A1 9/2011
(Continued)

OTHER PUBLICATIONS

PCT International Search Report and Written Opinion of International Searching Authority dated Oct. 12, 2016 corresponding to PCT International Application No. PCT/US2015/066226 filed Dec. 17, 2015.

*Primary Examiner* — Jason C Smith

(57) ABSTRACT

A monitoring and warning system is provided that measures a track displacement as an indication of an operational condition of railway tracks and a rail track structure. The system comprises a sensor and a device coupled to the sensor. In response to a physical measurement of a vertical displacement of a railway track in a down direction by the sensor, the device is configured to provide a warning signal indicative of a possible future failure of the railway track or the rail track structure for proactive track maintenance purposes.

17 Claims, 4 Drawing Sheets

(56) References Cited

U.S. PATENT DOCUMENTS

| | | | | |
|---|---|---|---|---|
| 2019/0031217 | A1* | 1/2019 | Buerger | B61K 9/08 |
| 2019/0257038 | A1* | 8/2019 | Wollanek | E01B 35/12 |

FOREIGN PATENT DOCUMENTS

| | | | |
|---|---|---|---|
| FR | 2994984 | A1 | 3/2014 |
| WO | 2006031774 | A2 | 3/2006 |
| WO | 2007009132 | A2 | 1/2007 |
| WO | 2015055347 | A1 | 4/2015 |

* cited by examiner

RAILWAY TRACK DISPLACEMENT MEASUREMENT SYSTEM AND METHOD FOR PROACTIVE MAINTENANCE

BACKGROUND

1. Field

Aspects of the present invention generally relate to monitoring condition of a railways installation such as rail track structure and more specifically relates to measuring a physical displacement of a railway track during use of the railway track for maintenance determination.

2. Description of the Related Art

Track work of railway tracks includes tracks or rails connected to a track structure with metal plates. It is known that poorly maintained track work can lead to a higher number of failures both caused by physical movement of the track work which causes adjustments to be negated and also due to continuous movement that can cause fatigue of components resulting in component failure.

As evident from a number of patents published and industry papers presented discussing the measurement of vibration, a lot of research work done has been done on measuring vibration for maintaining track work. However, this body of research generally puts the emphasis on vibration being the significant cause of failure of track work.

When a track structure deteriorates, the track ends up with a higher number of faults relative to a baseline due to damaged switches and components. As described above, the performance of the track structure is typically determined by measuring vibration levels.

A system for monitoring condition of a railways installation such as a points machine is known. Although monitoring of a railway installation such as a points machine is known, prior art monitoring has been of a limited scope and typically has been limited to measurement of vibration. Prior art monitoring generally has been useful for detecting faults in infrastructure subsequent to failure of the monitored elements. Analysis of points machine faults reported over a period has shown that significant fault modes are not failures of the points machine itself (e.g. motor problems), but are due to problems with mechanical alignment of the monitored installation, including the track.

While the equipment is designed well to deal with the vibration the track structure deteriorates under the track as the track structure bounces up and down when a train goes over the tracks. More the tracks go up and down one gets more failures and as components fatigue one gets more physical failures. For example, in one study, between 80-90% of reported faults were blamed on the points by a maintainer. Analysis of the data showed in excess of 10% fault reports (up to 15%) contain the track work packing, track pumping due to motion of train traffic or similar reasons.

Therefore, there is a need for improvements to rail track monitoring in the railroad industry, such as improvements in systems of monitoring indications of failures in rail track installation.

SUMMARY

Briefly described, aspects of the present invention relate to determining a track displacement as an indicator of an operational condition of the track for maintenance purposes by continuously monitoring in real time condition of a railways installation such as a railway track. In particular, a sensor coupled to a readout device may measure a physical displacement of a track in a vertical direction during use of the track relative to its nominal position and issue an alarm in the form of a warning signal to a central system or a hand-held device for undertaking a maintenance operation to correct a track structure. In this way, a failure occurrence can be preempted and would be safely handled by embodiments of a track monitoring and warning system of the present invention. One of ordinary skill in the art appreciates that such a track monitoring and warning system can be configured to be installed in different environments where such track monitoring and warning is needed, for example, in railway installations.

In accordance with one illustrative embodiment of the present invention, a measurement system is provided to determine physical displacement of a railway track during use of the railway track. The system comprises a transducer configured to be mounted at a connection point between a track and a sleeper of a track structure. The transducer measures a physical parameter of the track when a wheel of a train traverses over the track. The system further comprises a device operatively coupled to the transducer. The device determines vertical track displacement from the physical parameter measured by the transducer. The device generates a warning signal indicative of a degradation or failure of the track structure when the measured track displacement exceeds a predetermined threshold.

In accordance with another illustrative embodiment of the present invention, a method of determining a physical displacement of a railway track during use of the railway track is provided. The method includes measuring a physical parameter of a track coupled to a track structure using a sensor when a wheel of a train passes over the track, calculating vertical track displacement based on the measured physical parameter, determining degradation in condition of the track or track structure based on the vertical track displacement, and generating a warning signal based on the degradation in condition of the track or track structure.

In accordance with yet another illustrative embodiment of the present invention, an apparatus is provided to measure a physical displacement of a railway track during use of the railway track. The apparatus includes a sensor configured to measure a vertical displacement of a track coupled to a track structure when a wheel of a train traverses over the track with respect to a rest state of the track as a measure of an operational condition of the track.

DETAILED DESCRIPTION

To facilitate an understanding of embodiments, principles, and features of the present invention, they are explained hereinafter with reference to implementation in illustrative embodiments. In particular, they are described in the context of determining a track displacement for automatic monitoring of an operational condition of the track and track structure for predicatively maintaining the tracks in a failure less condition. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

A monitoring and warning system is provided for tracking failure indications in a railway track by continuously monitoring in real time condition of a railways installation such as a railway track. The system comprises a sensor configured to be mounted on a connection point between a track and a sleeper of a track structure. The system further comprises a device coupled to the sensor. In response to a determination of a vertical displacement of the track, the device to generate a warning signal indicative of a possible potential problem with the tracks or the track structure.

Accordingly, a safety system is provided for railway tracks being used by rail traffic which crosses over the tracks laid for plying trains on them. In one embodiment, by measuring a physical parameter indicative of vertical displacement of a track during use relative to a non-use state of them a warning is provided in advance of a track displacement beyond an acceptable level so a maintenance action can be initiated prior to occurrence of a failure of the tracks or the track structure. This solution ensures safety of occupants of trains.

In accordance with one illustrative embodiment of the present invention, a measurement system is provided to determine physical displacement of a railway track during use of the railway track. The system comprises a transducer configured to be mounted at a connection point between a track and a sleeper of a track structure. The transducer measures a physical parameter of the track when a wheel of a train traverses over the track. The system further comprises a device operatively coupled to the transducer. The device determines vertical track displacement from the physical parameter measured by the transducer. The device generates a warning signal indicative of a degradation or failure of the track structure when the measured track displacement exceeds a predetermined threshold.

Figure 1:
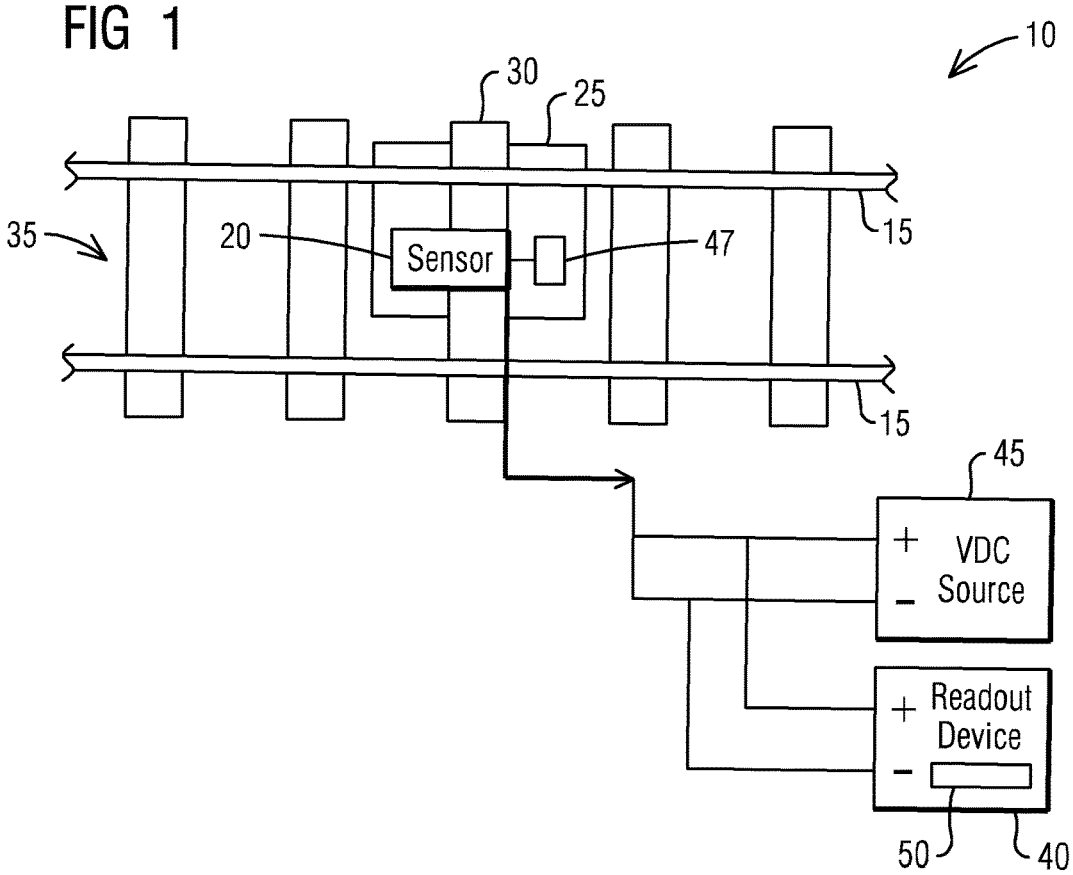
FIG. 1 illustrates a schematic diagram of a measurement system for use at railway tracks in accordance with one illustrative embodiment of the present invention.

FIG. 1 illustrates a schematic diagram of a measurement system 10 for use with railway tracks 15 in accordance with one illustrative embodiment of the present invention. For tracking failure indications based on track displacement in a railway track 15, the measurement system 10 comprises a sensor 20 configured to be mounted on a connection point on a metal plate 25 between the railway track 15 and a sleeper 30 of a rail track structure 35. The measurement system 10 further comprises a readout device 40 coupled to the sensor 20. A DC voltage power source (VDC) 45 may power the sensor 20. For example, a 15-30 Volts DC power may be provided by the VDC source 45. The measurement system 10 continuously monitor in real time condition of a railways installation such as the railway track 15.

Consistent with one embodiment, the sensor 20 may be configured to measure a physical parameter such as acceleration along with time at the same time to provide a measure of a displacement of the railway track 15 as shown in Equation (Eq.) 1 below.

$$v(t)=\int_{t_0}^{t} a(\tau)d\tau+v(t_0)x(t)=\int_{t_0}^{t} v(\tau)d\tau+x(t_0) \quad \text{Eq. 1}$$

where "t" is time, "x" is displacement, "v" is velocity and "a" is acceleration. The displacement "x" is the integral of velocity "v," which in turn is the integral of acceleration "a."

A vibration amplitude may also be measured as displacement, velocity, or acceleration. The vibration amplitude measurements may either be relative, or absolute. Displacement (x) measurement is the distance or amplitude displaced from a resting position. The SI unit for distance is the meter (m), although common industrial standards include mm and mils. Velocity ($\Delta x/\Delta t$) is the rate of change of displacement with respect to change in time. The SI unit for velocity is meters per second (m/s), although common industrial standards include mm/s and inches/s. Acceleration ($\Delta v/\Delta t$) is the rate of change of velocity with respect to change in time. The SI unit for acceleration is meters per second ($m/s^2$), although the common industrial standard is the "g". In one embodiment, acceleration vibration measurements may be made using an accelerometer.

According to one embodiment, the sensor 20 may be an accelerometer that comprises a housing, mass, a piezoelectric material and signal leads. A time measurement device to measure time may be coupled or integrated with the sensor 20. It should be appreciated that several other components may be included in the sensor 20 preferably as approved by American Railway Engineering and Maintenance-of-Way Association (AREMA). However, the function and use of such equipment for a railroad application are well known in the art and are not discussed further.

While particular embodiments are described in terms of the sensor 20 as an accelerometer, the techniques described herein are not limited to accelerometer but can be also used with other sensors, such as different types of vibration sensors could be deployed.

Examples of the sensor 20 include a transducer that measures an acceleration or a g-force and can be used to provide a measure of a displacement of the railway track 15. One example of such a transducer is an accelerometer such as model HS-422S (4-20 mA acceleration output via M12 connector) available from Hansford Sensors Ltd. of Artisan, Hillbottom Road, Sands Industrial Estate, High Wycombe, Buckinghamshire, HP12 4HJ UK. It has a vibration transmitter (loop powered sensor) for use with a programmable logic controller (PLC) using a 2-pin MS connector 'g' sensor PLC interface. In one embodiment, the transducer of the sensor 20 may include a magnet 47 to attach to the metal plate 25. A person skilled in the pertinent art would appreciate that other suitable sensors with transducers may be readily deployed based on a specific implementation without departing from the scope of the present invention.

In one embodiment, the sensor 20 may include a wireless communication interface to wirelessly communicate with the readout device 40 instead of using cables. In that case, the readout device 40 may include also a wireless communication interface to wirelessly communicate with the sensor 20. Both the sensor 20 and the readout device 40 may employ a Wi-Fi, Bluetooth or Zigbee wireless standard protocols for data communications and messaging. One skilled in the relevant art would understand that different suitable wireless standard protocols may be very well deployed based on a particular application without deviating from the spirit of the present invention.

Examples of the readout device 40 include a datalogger having a display and a user interface including a touch screen, switches, buttons and dials. The readout device 40 in one embodiment may include a microcontroller and a memory and firmware and/or software to communicate with the sensor 20 and process rail track related data for display. The readout device 40 may include a speaker to generate an alarm being audible in nature and a LED light for visual indication. It should be appreciated that several other components may be included in the readout device 40. However, the function and use of such equipment for a railroad application are well known in the art and are not discussed further.

The readout device 40 may communicate with a central monitoring system to control, receive and process rail track maintenance related operations. The readout device 40 may be a wired or a wireless device capable of outdoor use in the field.

In response to a higher measurement value of a physical displacement (see FIG. 2) than an acceptable level in a vertical down direction of the railway track 15 when a train passes over the railway track 15, the readout device 40 may generate a warning signal 50 indicative of a possible problem with the railway tracks 15 or the rail track structure 35 such as a poor ballast or formation leading to pumping of the track 15. For example, the warning signal 50 may be an audible alarm for an operator of the readout device 40. Alternatively, a software alarm may be triggered in a central monitoring system.

For measuring a vertical displacement of a track, the sensor 20 may measure a movement of itself to record the displacement data as the vertical displacement of the track in a datalogger. In one embodiment however, the sensor 20 optically measures the vertical displacement of the track 15 with a laser by detecting how much the track 15 moves down when the train passes over the track 15.

Figure 2:
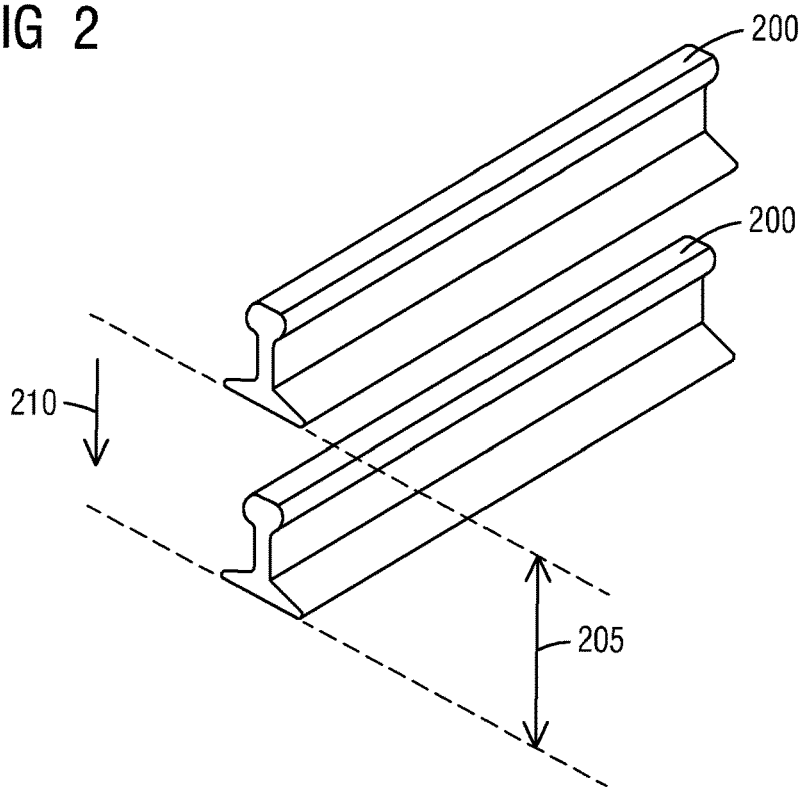
FIG. 2 illustrates a schematic diagram of railway tracks displacement measurement in accordance with one illustrative embodiment of the present invention.

Referring to FIG. 2, it illustrates a schematic diagram of railway tracks 200 in accordance with one illustrative embodiment of the present invention. As shown, the railway track 200 may vertically displace downwards due to a huge load of a train when a wheel of the train travels on a top surface of the railway track 200.

For example, a vertical displacement 205 in a down direction 210 may occur for the railway track 200 when a train passes over the railway track 200. Such track displacement may be 1 inch, which may be an acceptable level. However, due to poor packing, wear and tear, weather conditions, or design issues the vertical displacement 205 may be more than 1 inch and beyond the acceptable level as this could lead to a failure of the track structure or other equipment monitoring the railway installations.

To this end, embodiments of the present invention provide a monitoring and warning system which uses the measurement system 10 of FIG. 1 to determine a maintenance action in advance to an occurrence of a failure of the tracks or the track structure. In response to a determination of the vertical displacement 205 of the railway track 200, the readout device 40 of FIG. 1 may generate the warning signal 50 indicative of a possible problem with the railway track 200 or the track structure.

Active devices and systems may be used in the monitoring and warning system, such as point operating systems for the availability of the entire railway system. Signaling information as well as operational information may be transmitted by the monitoring and warning system.

Figure 3:
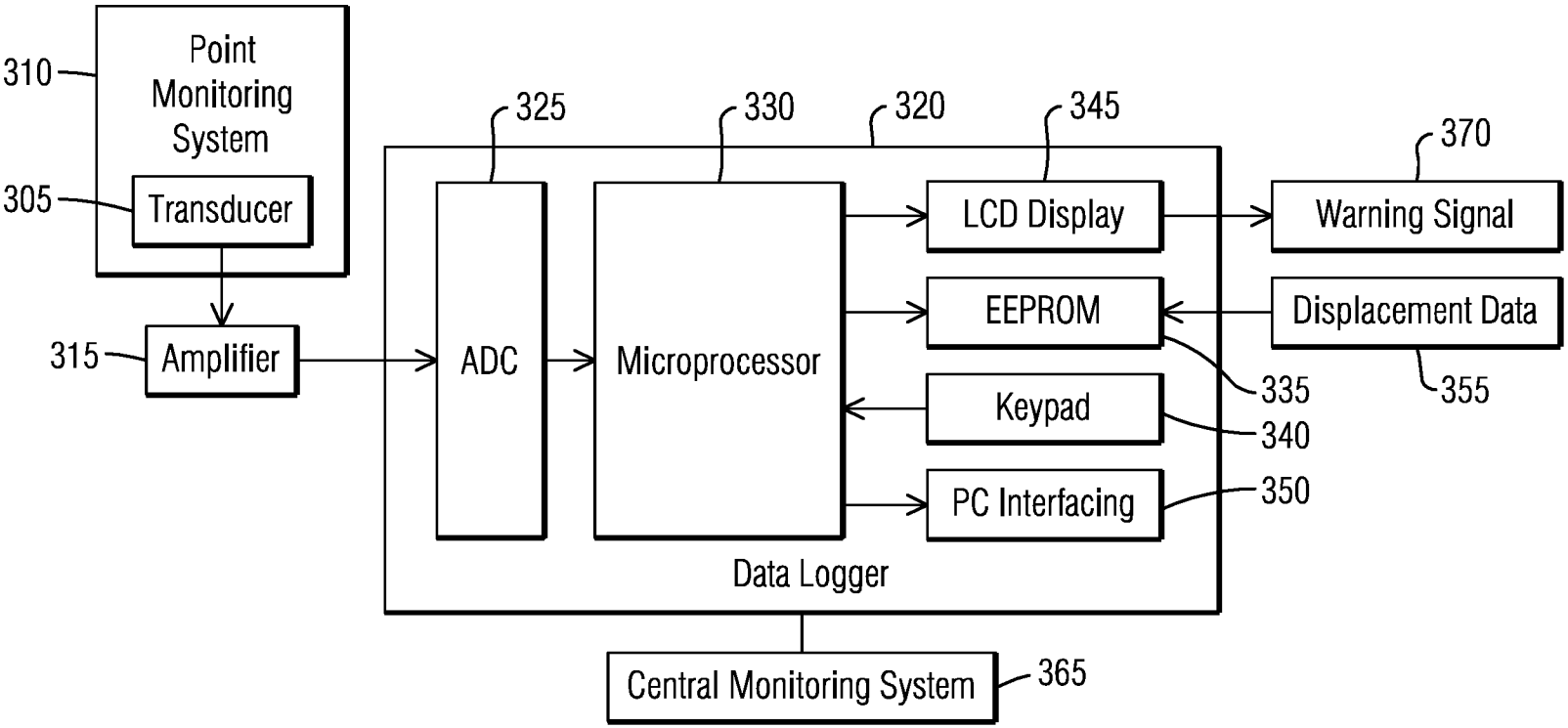
FIG. 3 illustrates a schematic diagram of a monitoring and warning system in accordance with one illustrative embodiment of the present invention.

FIG. 3 illustrates a schematic diagram of a monitoring and warning system 300 in accordance with one illustrative embodiment of the present invention. The monitoring and warning system 300 comprises a transducer 305 to measure a physical parameter indicative of the vertical displacement 205 of the railway track 200, as set forth above with respect to FIG. 1 and FIG. 2. As used herein, the "monitoring and warning system 300," in addition to the exemplary hardware description in FIGS. 3-4, refers to a system that is configured to process radio and/or data signals, operated by a controller (including but not limited to a sensor control unit, a wireless control unit, a track control unit, and others). The monitoring and warning system 300 can include multiple interacting systems, whether located together or apart, that together perform processes as described herein.

In accordance with one exemplary embodiment, for an automatic monitoring of the vertical displacement of the track, the transducer 305 may be integrated with a point monitoring sensor or a point monitoring system 310 deployed to monitor various parameters of a point machine. The point monitoring system 310 may include a distributed array of sensors adapted to gather data regarding the status of elements of the installation with which the sensors are associated. The point monitoring system 310 may utilize advanced algorithms to process the data for a variety of purposes including predicting failure of equipment, developing efficient maintenance schedules and managing railway assets in general.

The transducer 305 may be coupled to an amplifier 315, which feeds the displacement data into a datalogger 320. The datalogger 320 (also called data recorder) is an electronic device that records data over time or in relation to location with the transducer 305. The datalogger 320 may be based on a digital processor. The datalogger 320 may be a battery powered device and equipped with an analog to digital converter (ADC) 325, a micro-controller 330, internal memory EEPROM 335 for data storage, a local device interface (keypad 340, LCD display 345), and a PC interface 350. The datalogger 320 may interface with a personal computer, and use software to activate the datalogger 320 and view and analyze the collected track displacement data.

The datalogger 320 may be programmable in one embodiment. One of the primary benefits of using the datalogger 320 is its ability to automatically collect displacement data 355 on a 24-hour/7-days basis. Upon activation, the datalogger 320 is deployed and left unattended to measure and record information for the duration of a monitoring period. This allows for a comprehensive, accurate picture of the track displacement being monitored.

In one embodiment, with an operations control system, track displacement of railway tracks may be centrally monitored and controlled. For example, the datalogger 320 may communicate with a central monitoring system 365 to control, receive and process rail track maintenance related operations. A software alarm may be triggered in the central monitoring system 365 to initiate an automatic maintenance action based on an electronic maintenance determination done per a previously set criterion within the central monitoring system 365.

By the central monitoring system 365, an event monitoring system may be used to produce a log of time stamped 'events' showing a status of various controls and indications which can then be analyzed by engineers to ascertain if the monitoring and warning system 300 was performing appropriately. To assist in an analysis of the recorded displacement data 355, an event browser and graphical display options may enable events stored by the datalogger 320 to be converted into a visual representation such as a warning signal 370 of the monitoring activity, consistent with what would be seen on a control panel.

Depending on a size of a railway track area monitored, a number of different screens may be accessed through a main overview of the central monitoring system 365. For example, a client software may provide a graphical interface to monitor tracks and track structure and performance with light indicators to show instantly which sites or assets are in alarm or alert. In this way, an analysis may be done of real time track performance and the displacement data 355 collected by the monitoring and warning system 300 using data acquisition hardware plus software.

Tack movement profiles may be recorded by the central monitoring system 365 to be plotted against time for detailed analysis. A graphical tool may be used to visualize the displacement data 355 and assist in failure diagnosis. A detailed trend detector may be used for the displacement data 355 measured over a relatively long period of time—e.g. hours to months. Where alarms are created as a result of routine maintenance they can be handled using a client application or by sending a message to a computer server. From an alarm list, individual alarm events may be selected and acknowledged.

The central monitoring system 365 may utilize an email server tool to automatically produce an email report of active alarms. A set of dedicated reporting tools may enable maintainers to display and export specific parameters relating to rail track performance and develop their own custom reports. Examples include number of operations, failures, alarms or irregularities for a particular track structure.

The central monitoring system 365 may include integrated automation functions for optimum dispatching and efficient operations management on lines and at stations. An automatic train control system may continuously monitor all movements of the trains on lines and at stations and provide safe signaling. Automatic functions may support the operating personnel and drivers, making high speeds possible and enabling the line and network resources to be utilized to maximum capacity.

In one embodiment, the readout device 40 or the datalogger 320 coupled to the transducer 305 is a hand-held device capable of monitoring the vertical displacement 205 of the railway track 200 for a maintenance determination. The datalogger 320 is coupled to the transducer 305 such that the transducer 305 measures a movement of itself to record the displacement data 355 as the vertical displacement 205 of the railway track 200 in the datalogger 320.

Figure 4:
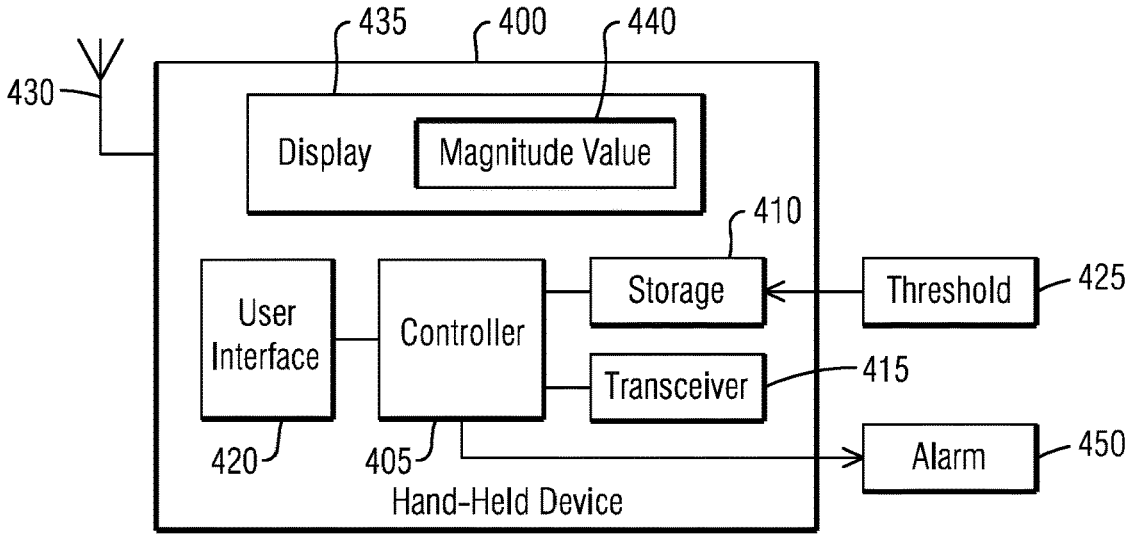
FIG. 4 illustrates a schematic diagram of a hand-held device in accordance with one illustrative embodiment of the present invention.

As shown, FIG. 4 illustrates a schematic diagram of a hand-held device 400 in accordance with one illustrative embodiment of the present invention. The hand-held device 400 may be deployed in lieu of using the central monitoring system 365 for monitoring the railway track 200 of FIG. 2 as a standalone device by a track operator. However, in some other embodiments, the hand-held device 400 may be used in conjunction with the central monitoring system 365.

As can be seen, in one embodiment, the hand-held device 400 may comprise a controller 405 coupled to a storage device 410, a transceiver 415 and a user interface 420. The storage device 410 may store a threshold value 425 of a maximum vertical displacement acceptable by the track operator and/or industry standard for a safe operation of the railway track 200. The transceiver 415 may use an antenna 430 to communicate with the transducer 305 of FIG. 3. The transducer 305 may include a transceiver of its own compatible with the wireless communications received from the transceiver 415. The user interface 420 may enable the track operator to interact with the hand-held device 400. The user interface 420 may include a keypad, buttons, dials etc.

The hand-held device 400 may further comprise a display 435 to display a magnitude value 440 from the collected displacement data 355. The controller 405 may compare the magnitude value 440 to the threshold value 425 and when the magnitude value 440 exceeds the threshold value 425, it may generate an alarm 450. The alarm 450 may be an audible alarm or a visual alarm or a combination of both.

Figure 5:
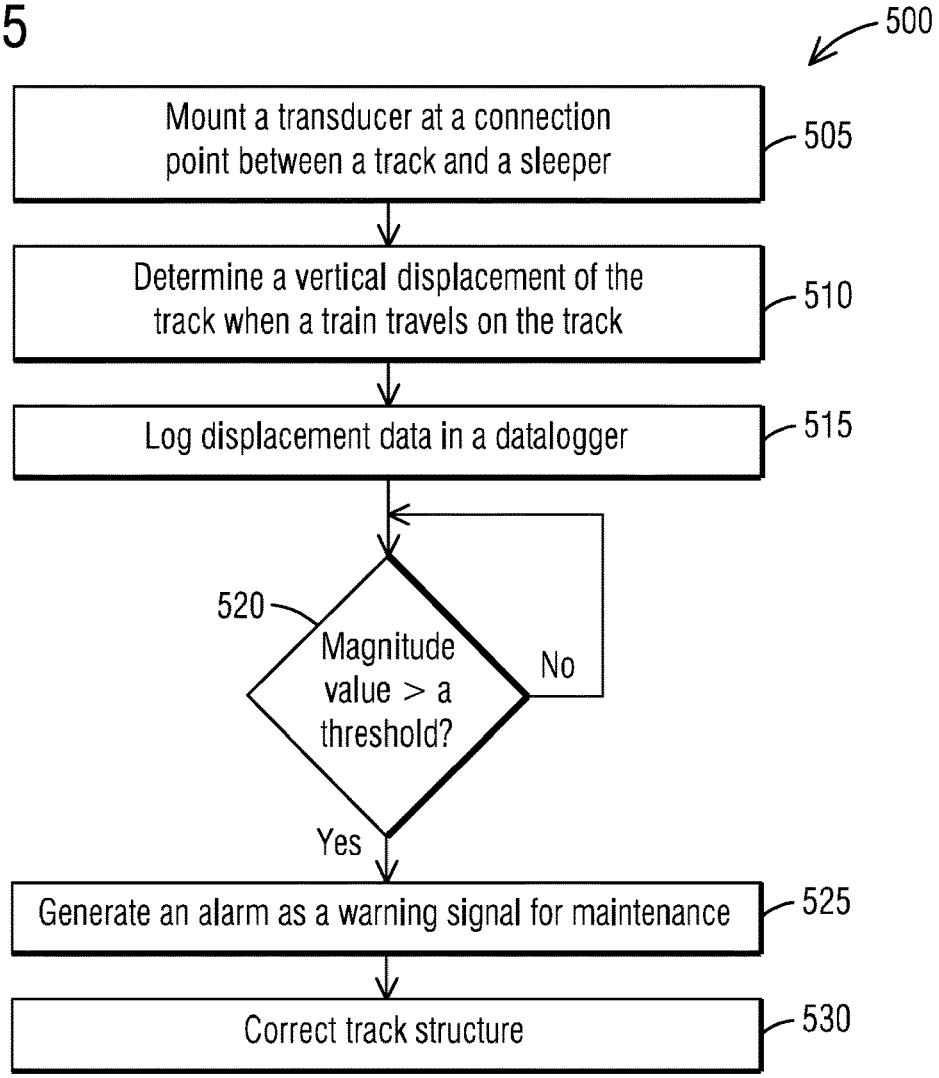
FIG. 5 illustrates a flow chart of a method for determining a track displacement to monitor an operational condition of the track and track structure for maintaining the track and track structure in accordance with an exemplary embodiment of the present invention.

FIG. 5 illustrates a flow chart of a method 500 for determining a track displacement to monitor an operational condition of the track and track structure for maintaining the track and track structure in accordance with an exemplary embodiment of the present invention. Reference is made to the elements and features described in FIGS. 1-4. It should be appreciated that some steps are not required to be performed in any particular order, and that some steps are optional.

In step 505, the transducer 305 may be mounted at a connection point between the railway track 15 and the sleeper 30. To determine vertical displacement 205 of the railway track 15 a physical parameter such as vibration may be measured by the transducer 305 when a train travels on the railway track 15, as shown in step 510. The datalogger 320 may log in step 515 the displacement data 355 based on the determination of the track displacement recorded in step 510.

At a decision point 520, the hand-held device 400 may compare the magnitude value 440 to the threshold value 425 and when the magnitude value 440 exceeds the threshold value 425, it may generate the alarm 450 in step 525. Otherwise, the monitoring and warning system 300 may continue to loop back to make a repetitive check of a level of the magnitude value 440 relative to the threshold value 425. At step 530, based on the alarm 450 generated in step 525 a maintenance action may be initiated to correct the track structure 35.

Figure 6:
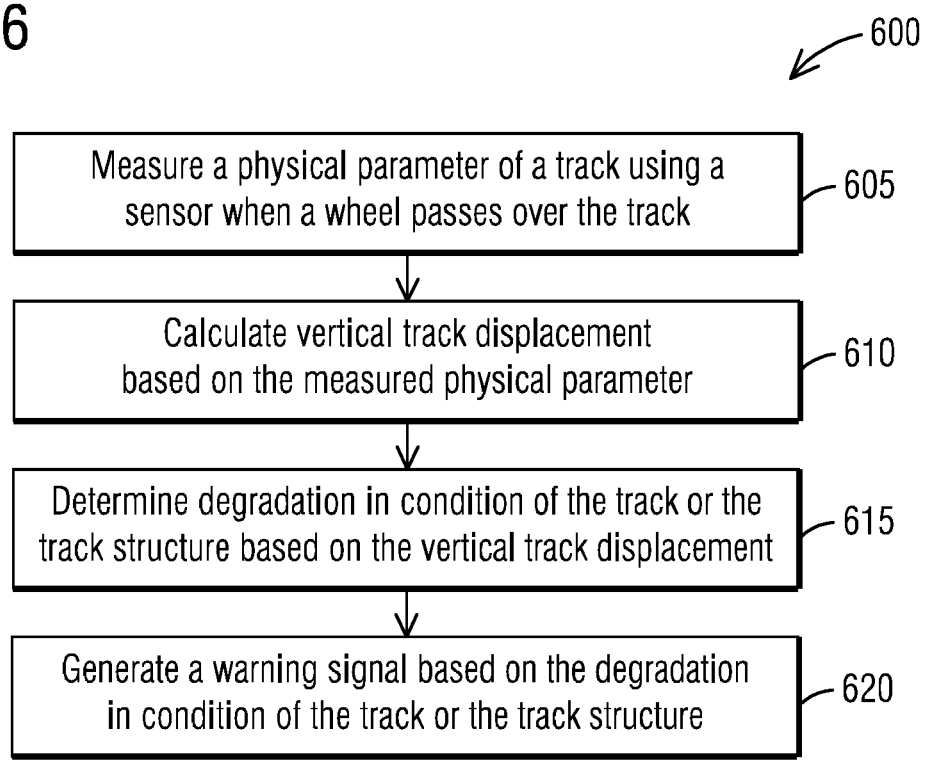
FIG. 6 illustrates a flow chart of a method for determining physical displacement of a railway track during use of the railway track in accordance with an exemplary embodiment of the present invention.

FIG. 6 illustrates a flow chart of a method 600 for determining physical displacement of a railway track during use of the railway track in accordance with an exemplary embodiment of the present invention. Reference is made to the elements and features described in FIGS. 1-4. It should be appreciated that some steps are not required to be performed in any particular order, and that some steps are optional.

The method 600 of determining physical displacement of a railway track during use of the railway track in step 605 includes measuring a physical parameter of a track coupled to a track structure using a sensor when a wheel of a train passes over the track. In step 610, vertical track displacement may be calculated based on the measured physical parameter. Degradation in condition of the track or track structure is determined based on the vertical track displacement in step 615. A warning signal is generated based on the degradation in condition of the track or track structure in step 620.

Embodiments of the present invention provide for a continuous measurement of track displacement caused by the traffic of trains. Such a continuous monitoring of the railway track and rail track structure may reveal deterioration of the track structure particularly at points or switches where such deterioration can result in failures. This type of measurement is suitable for automatic recording and monitoring unlike vibration which requires analysis and processing to reveal changes. To achieve a continuous measurement of track displacement specifically engineered sensors that perform the conversion from vibration to displacement are provided. With these sensors, suitable data acquisition systems are provided as monitoring systems to record the displacements. These systems can be deployed with point monitoring systems as track deflection detection may be added as a parameter to be monitored.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A measurement system to determine physical displacement of a railway track during use of the railway track, the system comprising:

a transducer configured to be mounted at a connection point between a track and a sleeper of a track structure, the transducer measuring a physical parameter of the track when a wheel of a train traverses over the track; and a device operatively coupled to the transducer, the device determining vertical track displacement from the physical parameter measured by the transducer, the device generating a warning signal indicative of a degradation or failure of the track structure when the measured track displacement exceeds a predetermined threshold, wherein the device coupled to the transducer is a handheld device capable of monitoring the vertical displacement for a maintenance determination.

2. The system of claim 1, wherein the physical parameter of the track is measured with respect to a rest state of the track for indicating a measure of an operational condition of the track, wherein the measure of the operational condition of the track is an indication of a poor ballast or formation leading to pumping of the track.

3. The system of claim 1, wherein the transducer is integrated with a point monitoring sensor for an automatic monitoring of the vertical displacement of the track.

4. The system of claim 1, further comprising:

a datalogger coupled to the transducer, wherein the transducer measures a movement of itself to record the displacement data as the vertical displacement of the track in the datalogger.

5. The system of claim 1, wherein the device further comprising:

a display to indicate the displacement data as a magnitude value for the vertical displacement of the track for a user to show whether the vertical displacement of the track is beyond an acceptable level.

6. The system of claim 5, wherein the device to determine whether the magnitude value exceeds a threshold and generate an alarm if the magnitude value exceeds the threshold.

7. A measurement system to determine physical displacement of a railway track during use of the railway track, the system comprising:

a transducer configured to be mounted at a connection point between a track and a sleeper of a track structure, the transducer measuring a physical parameter of the track when a wheel of a train traverses over the track; and a device operatively coupled to the transducer, the device determining vertical track displacement from the physical parameter measured by the transducer, the device generating a warning signal indicative of a degradation or failure of the track structure when the measured track displacement exceeds a predetermined threshold, wherein the track is connected to the sleeper with a metal plate and the transducer includes a magnet to attach to the metal plate.

8. A measurement system to determine physical displacement of a railway track during use of the railway track, the system comprising:

a transducer configured to be mounted at a connection point between a track and a sleeper of a track structure, the transducer measuring a physical parameter of the track when a wheel of a train traverses over the track; and a device operatively coupled to the transducer, the device determining vertical track displacement from the physical parameter measured by the transducer, the device generating a warning signal indicative of a degradation or failure of the track structure when the measured track displacement exceeds a predetermined threshold, wherein the transducer measures an acceleration and a time at the same time to provide a value for the vertical displacement of the track.

9. A method of monitoring a railway track during use of the railway track, the method comprising:

measuring a physical parameter of a track coupled to a track structure using a sensor when a wheel of a train passes over the track;

calculating vertical track displacement based on the measured physical parameter;

determining a degradation condition of the track or track structure based on the vertical track displacement; and generating a warning signal based on the degradation condition of the track or track structure.

10. The method of claim 9, further comprising:

mounting a transducer at a connection point between the track and a sleeper of the track structure to determine the vertical track displacement.

11. The method of claim 10, further comprising:

correcting the track structure based on displacement data before a current state of the track results in a failure.

12. The method of claim 10, wherein determining vertical track displacement of a track further comprising:

optically measuring a vertical displacement of the track with a laser by detecting how much the track moves down when the train passes over the track.

13. The method of claim 10, determining vertical track displacement of a track further comprising:

measuring a movement of a transducer by the transducer to record displacement data as the vertical track displacement in a datalogger.

14. The method of claim 10, further comprising:

displaying displacement data as a magnitude value for the vertical track displacement for a user to show whether the vertical track displacement is beyond an acceptable level.

15. The method of claim 14, further comprising:

determining whether the magnitude value exceeds a threshold; and generating an alarm if the magnitude value exceeds the threshold.

16. The method of claim 10, wherein determining vertical track displacement of a track further comprising:

measuring an acceleration and a time at the same time to provide a value for the vertical track displacement.

17. The method of claim 10, further comprising:

integrating a transducer with a point monitoring sensor for an automatic monitoring of the vertical track displacement.

* * * * *